US007920015B2

(12) United States Patent
Chellappa

(10) Patent No.: US 7,920,015 B2
(45) Date of Patent: Apr. 5, 2011

(54) METHODS AND APPARATUS TO SENSE A PTAT REFERENCE IN A FULLY ISOLATED NPN-BASED BANDGAP REFERENCE

(75) Inventor: Ananthasayanam Chellappa, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 202 days.

(21) Appl. No.: 11/932,142

(22) Filed: Oct. 31, 2007

(65) Prior Publication Data

US 2009/0108918 A1 Apr. 30, 2009

(51) Int. Cl.
*G05F 3/26* (2006.01)
*G05F 3/16* (2006.01)

(52) U.S. Cl. ..... 327/513; 327/539; 323/315; 323/314

(58) Field of Classification Search ..... None
See application file for complete search history.

(56) References Cited

U.S. PATENT DOCUMENTS 6,815,941 B2 11/2004 Butler
7,199,646 B1 * 4/2007 Zupcau et al. ..... 327/539
7,227,401 B2 * 6/2007 Zhang et al. ..... 327/513
7,253,599 B2 8/2007 Chen et al.
7,276,890 B1 * 10/2007 Kumar ..... 323/313
7,495,505 B2 * 2/2009 Chang et al. ..... 327/539
7,570,107 B2 * 8/2009 Kim et al. ..... 327/539
2009/0108917 A1 * 4/2009 Chellappa ..... 327/539
2009/0110027 A1 * 4/2009 Chellappa ..... 374/178

OTHER PUBLICATIONS

Rincón-Mora, G.A. "Bandgap Voltage Reference" ECE4430 Analog Integrated Circuits, 14 pages (metadata indicates document created on Dec. 2, 2002).
"Introduction to Bandgap Reference Generators," Texas A&M University, 607(ESS), 18 pages (metadata indicates document created on Feb. 10, 2005).

* cited by examiner

*Primary Examiner* — Lincoln Donovan
*Assistant Examiner* — Terry L Englund
(74) *Attorney, Agent, or Firm* — John J. Patti; Wade J Brady, III; Frederick J. Telecky, Jr.

(57) ABSTRACT

In a traditional, fully-isolated bandgap reference circuits, it was difficult to detect currents that are proportional to absolute temperature (PTAT). Here, a PTAT reference in a fully isolated NPN-based bandgap references are disclosed. These circuits in particular are able to make detections using various current without the need for stand-along operational amplifiers.

8 Claims, 7 Drawing Sheets

METHODS AND APPARATUS TO SENSE A PTAT REFERENCE IN A FULLY ISOLATED NPN-BASED BANDGAP REFERENCE

TECHNICAL FIELD

The present disclosure pertains to voltage bandgap references and, more particularly, to methods and apparatus to sense a PTAT reference in a fully isolated NPN-based bandgap reference.

BACKGROUND

Bandgap voltage references are circuits that generate a temperature-stable voltage by combining a p-n junction voltage with a thermal voltage. In many circuits and devices (e.g., analog-to-digital converters, etc.), a precise voltage reference is required to operate the circuits and/or devices at a precise level. Persons of skill in the art will readily appreciate that temperature affects a threshold voltage at which a transistor operates. Generally, a bandgap reference is used to generate such a reference voltage that is temperature independent. To form a bandgap reference, a complementary-to-absolute-temperature (CTAT) voltage reference is generated that decreases with increasing temperature (i.e., the CTAT voltage has a negative temperature coefficient). The bandgap reference also forms a proportional-to-absolute-temperature (PTAT) voltage that increases with increasing temperature (i.e., the PTAT voltage has a positive temperature coefficient). When the PTAT and CTAT voltages are combined properly, their respective temperature coefficients cancel each other out, thereby resulting in a temperature stable voltage. In other examples, a PTAT voltage is also generated for other purposes (e.g., to provide a voltage that varies and represents temperature, etc.).

FIG. 1 illustrates a conventional fully isolated NPN-based bandgap reference circuit 100. Generally, in a fully isolated circuit, the only nodes that are coupled with the substrate are solid nodes (e.g., ground, voltage supply, etc.), thereby preventing collecting charge carriers from being injected into the example circuit 100 by other circuits. To isolate the circuit 100, the fabrication process provides an NPN transistor having a collector that is an N-type well. The NPN transistor also includes the base and emitter in the N-type well. In FIG. 1, the circuit 100 includes a voltage supply 101, a transistor 102, ground 103, and a transistor 104 having a larger current density than the transistor 102, thereby requiring a larger base-emitter voltage than the transistor 102 before the second transistor 104 will turn on. Transistors 102 and 104 are part of the constant current generator 110, and transistors 102 and 104 are isolated by coupling their respective collectors directly to the voltage supply 101. A resistor 109 is placed in series with the transistor 102 to measure the difference between the base-emitter voltages of the transistors 102 and 104. A resistor 106 is placed in parallel with the transistor 102 and a resistor 109 having a substantially equal resistance to resistor 106. Resistors 109 and 106 are coupled together at node 110 and the emitter of the transistor 104 is coupled to the resistor 108 at node 115.

Nodes 110 and 115 are also the inputs of a control circuit 120, which mirrors the voltages and currents between the nodes 110 and 115. In other words, the voltages at nodes 110 and 115 are substantially equal and the current flowing from nodes 110 and 115 into the control circuit 120 are also substantially equal. NMOS transistors 126 and 128 are matched, meaning that the transistors 126 and 128 are configured to have substantially identical device parameters (e.g., gate width-to-length ratios, etc.). Similarly, the PMOS transistors 122 and 124 are also matched. The transistor 104 sets the voltage at node 115 to the base-emitter voltage drop below the voltage supply 101. Therefore, the current flowing through the resistor 108 is the base-emitter junction voltage of the transistor 104 divided by the resistance of the resistor 108. As temperature increases, the base-emitter voltage decreases, thereby causing the current through resistor 108 to be the CTAT current $I_{CTAT}$. The voltage at the node 110 is the voltage of node 115, thereby causing the CTAT current $I_{CTAT}$ to also flow into node 110 via the resistor 106.

In general, the currents flowing into the drains of the PMOS transistors 122 and 124 are substantially equal and the voltage at the source of the PMOS transistors 122 and 124 are also substantially equal. Persons of ordinary skill in the art will readily appreciate that the drain-source current of an NMOS transistor or a PMOS transistor in saturation is described by equation (1).

$$I_{DS} = \mu_n C_{OX} \frac{W}{L}(1 + \lambda V_{DS})(V_{GS} - V_{th}) \tag{1}$$

where $\mu_n$ is the average carrier mobility, $C_{OX}$ is the gate oxide capacitance per unit area, W is the gate width, L is the gate length, $\lambda$ is the channel-length modulation parameter, $V_{DS}$ is the drain-source voltage, $V_{GS}$ is the gate-source voltage, and $V_{th}$ is the threshold voltage of the transistor. As described above, the gates of the NMOS transistors 126 and 128 are coupled together and the sources of the NMOS transistors 126 and 128 are both coupled to ground, thereby forcing the NMOS transistors 126 and 128 to have substantially equal gate-source voltages. Thus, by matching the NMOS transistors 126 and 128, their drain-source currents will also be substantially equal.

By coupling the drain and the gate of the NMOS transistor 126, the NMOS transistor 126 sets its gate-source voltage to allow the drain-source current to flow through the NMOS transistor 126. As described above, the same gate-source voltage is applied to the gate of the NMOS transistor 128, thereby forcing the drain-source current of the NMOS transistor 128 to be equal or substantially equal to the drain-source current of the NMOS transistor 126. Persons having ordinary skill in the art will readily appreciate that NMOS transistors 126 and 128 form a current mirror whereby NMOS transistor 128 mirrors (i.e., substantially copies) the reference current of the NMOS transistor 126. Moreover, the additional current mirrors may be implemented by any active device (e.g., PMOS transistors, NPN bipolar transistors, etc.) without affecting the current flowing through the NMOS transistor 126.

As described above, the drain-source currents of the NMOS transistors 126 and 128 are configured to be equal or substantially equal. Due to NMOS transistors 126 and 128, the drain-source currents from the PMOS transistors 122 and 124 must also be equal or substantially equal. In the example of FIG. 4A, the PMOS transistors 122 and 124 are matched, thereby forcing the gate-source voltages of the PMOS transistors 122 and 124 to be equal or substantially equal. Thus, the controller 120 forces the voltages at the nodes 110 and 115 to be substantially equal and also forces the currents flowing from nodes 110 and 115 to be substantially equal.

In the constant current generator 110, the NPN transistor 104 is configured to operate as a diode and reduces the voltage at the node 115 based on the base-emitter junction voltage (i.e., $V_{BE1}$) of the NPN transistor 104. In other words, the voltage applied to both nodes 110 and 115 is forced by the NPN transistor 104, and the voltages are described by equation (2):

$$V_{110}, V_{115} = V_{SS} - V_{BE104} \tag{2}$$

where $V_{110}$ and $V_{115}$ are the voltages at nodes 110 and 115, respectively, $V_{BE104}$ is the base-emitter reference voltage drop across the base-emitter junction of the NPN transistor 104, and $V_{SS}$ is the voltage of the voltage source 101. Because the voltage at nodes 115 and 110 are forced to be equal, the current flowing through the resistors 106 and 108 are also known by equations (3) and (4):

$$I_{R106} = \frac{V_{BE104}}{R_{106}} \tag{3}$$

$$I_{R108} = \frac{V_{BE104}}{R_{108}} \tag{4}$$

where $V_{BE404}$ is the base-emitter voltage across the NPN transistor 104 and $R_{104}$ and $R_{108}$ are the resistance value of resistors the 106 and 108, respectively.

The currents flowing from the nodes 110 and 115 to the control circuit 120 are substantially equal. Additionally, the currents from resistors 106 and 108 are also substantially equal, thereby causing the current flowing across the NPN transistors 102 and 104 to be substantially equal. In FIG. 1, the current flowing through the NPN transistor 102 determines the current flowing across the NPN transistor 104. To control the current across the NPN transistors 102 and 104, the NPN transistor 102 is selected to have a smaller current density than the NPN transistor 104 so that the base-emitter junction voltage is smaller, thereby configuring the NPN transistor 102 as a diode with a smaller base-emitter voltage (i.e., $V_{BE}$). A voltage loop equation for the NPN transistors 102 and 104 is shown in equation (5):

$$V_{BE104} + V_{GS124} - V_{GS122} - I_{102}R_{109} - V_{BE102} = 0 \tag{5}$$

where $V_{BE104}$ is the base-emitter voltage of the NPN transistor 404, $V_{GS124}$ and $V_{GS122}$ are the respective gate-source voltage of the PMOS transistors 122 and 124, $I_{102}$ is the current flowing across the NPN transistor 102, $R_{109}$ is the resistance of resistor 109 and $V_{BE102}$ is the base-emitter voltage of the NPN transistor 102. Solving for current, the current that flows across the NPN transistors 102 and 104 is described in equation (6):

$$I_{102}, I_{104} = \frac{V_{BE104} - V_{BE102}}{R_{109}} = \frac{\Delta V_{BE}}{R_{409}} = I_{PTAT} \tag{6}$$

where $\Delta V_{BE}$ is the difference in the base-emitters voltages between the NPN transistors 102 and 104 (i.e., $\Delta V_{BE} = V_{BE104} - V_{BE102}$) and $R_{109}$ is the resistance of resistor 109. Additionally, the resistances of the resistors are substantially constant over temperature.

In the constant current generator 110, the thermal voltages (i.e., $V_T = k*T/q$, where k is Boltzmann's constant, T is temperature, and q is the charge of an electron) of the NPN transistors 102 and 104 increase as temperature increases. As a result, the thermal voltage causes the emitter currents of the NPN transistors 102 and 104 to decrease. The emitter current flowing via the NPN transistors is described by equation (7):

$$I_E = J_S A\left(e^{\frac{V_{BE}}{V_T}} - 1\right) \tag{7}$$

where $J_S$ is the current density, A is the emitter size, $V_{BE}$ is the base emitter junction, and $V_T$ is the thermal voltage. Due to the smaller current density of the NPN transistor 102, the emitter current (i.e., $V_{BE102}$) increases with temperature at a greater rate than the emitter current (i.e., $V_{BE104}$) of the NPN transistor 104, thereby causing the current flowing through resistor 109 to increase. In other words, the current flowing through resistor 109 increases as temperature increases (i.e., the current has a positive temperature coefficient). Therefore, the current flowing via resistor 109 is proportional-to-absolute-temperature (i.e., the PTAT current $I_{PTAT}$). Given the ratio between the emitter sizes of transistors 102 and 104, the PTAT voltage $V_{PTAT}$ is found per equation (8):

$$V_{PTAT} = \Delta V_{BE} = V_T \ln(N) \tag{8}$$

where N is the ratio between the emitter sizes of transistors 102 and 104, and $V_T$ is the thermal voltage.

In contrast, the base-emitter junction voltage of transistor 104 decreases as temperature rises, which thereby increases the voltage at nodes 110 and 115. Thus, the current flowing into the nodes 110 and 115 via resistors 106 and 108, respectively, decreases as temperature increases. That is, the current flowing into nodes 110 and 115 via resistors 106 and 108, respectively, is complementary-to-absolute-temperature (i.e., the current has a negative temperature coefficient). The CTAT current $I_{CTAT}$ and the PTAT current $I_{PTAT}$ are described by:

$$I_{PTAT} = \frac{\Delta V_{BE}}{R_{109}} \tag{9}$$

$$I_{CTAT} = \frac{V_{BE104}}{R_{106}} \tag{10}$$

where $\Delta V_{BE}$ is the difference in the base-emitter voltages between the NPN transistors 102 and 104 (i.e., $\Delta V_{BE} = V_{BE104} - V_{BE102}$), $R_{109}$ is the resistance of resistor 109, and $R_{106}$ is the resistance value of resistor 106. The current flowing out of the nodes 110 and 115 is the sum of the CTAT current $I_{CTAT}$ and the PTAT current $I_{PTAT}$. In some examples, the negative temperature coefficient of the CTAT current and the positive temperature coefficient of the PTAT current cancel each other out (e.g., via a ratio between resistors 406 and 409), thereby forming a constant current ($I_{CONST}$) that is substantially constant over a change temperature.

In other words, because the transistors 102 and 104 have different current densities, their respective base-emitter junction voltages differ and the current flowing through the resistor 109 will be the based on the difference in the base-emitter junction voltages of the transistors 102 and 104 and the resistance of the resistor 109. As temperature increases, the increasing difference in the base-emitter voltages of transistors 102 and 104 cause the current flowing through the resistor 109 to increase, thereby causing the voltage across the resistor 109 to increase as temperature increases. Thus, the current flowing through resistor 109 forms the PTAT current $I_{PTAT}$. The sum of the PTAT current $I_{PTAT}$ and the CTAT current $I_{CTAT}$ is the constant current $I_{CONST}$. In FIG. 1, the CTAT current $I_{CTAT}$ and PTAT current $I_{PTAT}$ are generated in a single voltage loop.

However, to sense the PTAT voltage $V_{PTAT}$, an operational amplifier 130 is coupled to the node 115. The operational amplifier 130 forces the voltage at an emitter of a transistor 140 to be the difference between the base-emitter voltage of the transistor 140 and the voltage source (i.e., $V_{SS}-V_{BE}$). In FIG. 1, the transistor 140 may have the same current density as the transistor 102. Because the base and collector of the transistor 140 are coupled to the voltage source 101 and the voltage across the base-emitter junction is forced by the operational amplifier 130, the transistor 140 sources the PTAT current $I_{PTAT}$. To generate the PTAT voltage $V_{PTAT}$, a current mirrors 150 and 151 may be implemented to mirror the PTAT current $I_{PTAT}$, thereby copying the PTAT current $I_{PTAT}$ and forming PTAT voltage $V_{PTAT}$ drop across the resistor 160.

SUMMARY

A preferred embodiment of the present invention, accordingly, provides an apparatus. The apparatus comprising a first voltage rail; a second voltage rail; a current generator that provides at least one of a first current that is proportional to absolute temperature, a second current that is complementary to absolute temperature, and a third current that is generally constant, wherein the current generator has a first stage and a second stage, wherein the first stage includes: a first bipolar transistor that is coupled to the first voltage rail at its base and its collector; a second bipolar transistor that is coupled to the first voltage rail at its base and its collector; a first resistor that is coupled to the emitter of the first bipolar transistor; a first current mirror having a first terminal, a second terminal, a third terminal, and a fourth terminal, wherein the first and second terminals of the first current mirror are coupled to the first resistor and the emitter of the second transistor, respectively; and a second current mirror having a first terminal, a second terminal, a third terminal, and a fourth terminal, wherein the first and second terminals of the second current mirror are coupled to the third and fourth terminals of the first current mirror, and wherein the third and fourth terminals of the second current mirror are coupled to the second voltage rail; and wherein the second stage includes: a second resistor that is coupled to the first voltage rail; a first MOS transistor that is coupled to the second resistor at its source and that is coupled to the fourth terminal of the first current mirror at its gate; and a second MOS transistor that is coupled to the drain of the first MOS transistor at its drain and that is coupled to the third terminal of the first current mirror at its gate; and a output stage that is coupled to the current generator so as to generate at least one of a first voltage that is generally constant, a second voltage that is proportional to absolute temperature, and a third voltage that is complementary to absolute temperature from at least one of the first current, the second current, and the third current.

In accordance with a preferred embodiment of the present invention, the first stage further comprises: a third resistor that is coupled between the first voltage rail and the first terminal of the first current mirror; and a fourth resistor that is coupled between the first voltage rail and the second terminal of the first current mirror.

In accordance with a preferred embodiment of the present invention, the second stage further comprises: a third current mirror with a first terminal coupled to the first voltage rail, a second terminal coupled to the first voltage rail, a third terminal, and a fourth terminal; a third MOS transistor that is coupled to the third terminal of the third current mirror at its drain; and a fourth MOS transistor that is coupled to the first voltage rail at its source, the source of the first MOS transistor at its drain, the gates of the first and second MOS transistors at its gate.

In accordance with a preferred embodiment of the present invention, the first stage further comprises a capacitor that is coupled between the first voltage rail and the gate of the first MOS transistor at its gate.

In accordance with a preferred embodiment of the present invention, the output stage further comprises a PTAT voltage generator having: a fifth MOS transistor that is coupled to the gate of the fourth MOS transistor at its gate; and a fourth current mirror that is coupled to the source of the fifth MOS transistor.

In accordance with a preferred embodiment of the present invention, the first stage further comprises a PTAT current generator and the second stage further comprises a complementary to absolute temperature (CTAT) current generator.

In accordance with a preferred embodiment of the present invention, the PTAT generator further comprises a capacitor that is coupled between the first voltage rail and the fourth terminal of the first current mirror.

In accordance with a preferred embodiment of the present invention, the output stage further comprises a temperature detector.

In accordance with a preferred embodiment of the present invention, the second voltage rail is coupled to ground.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
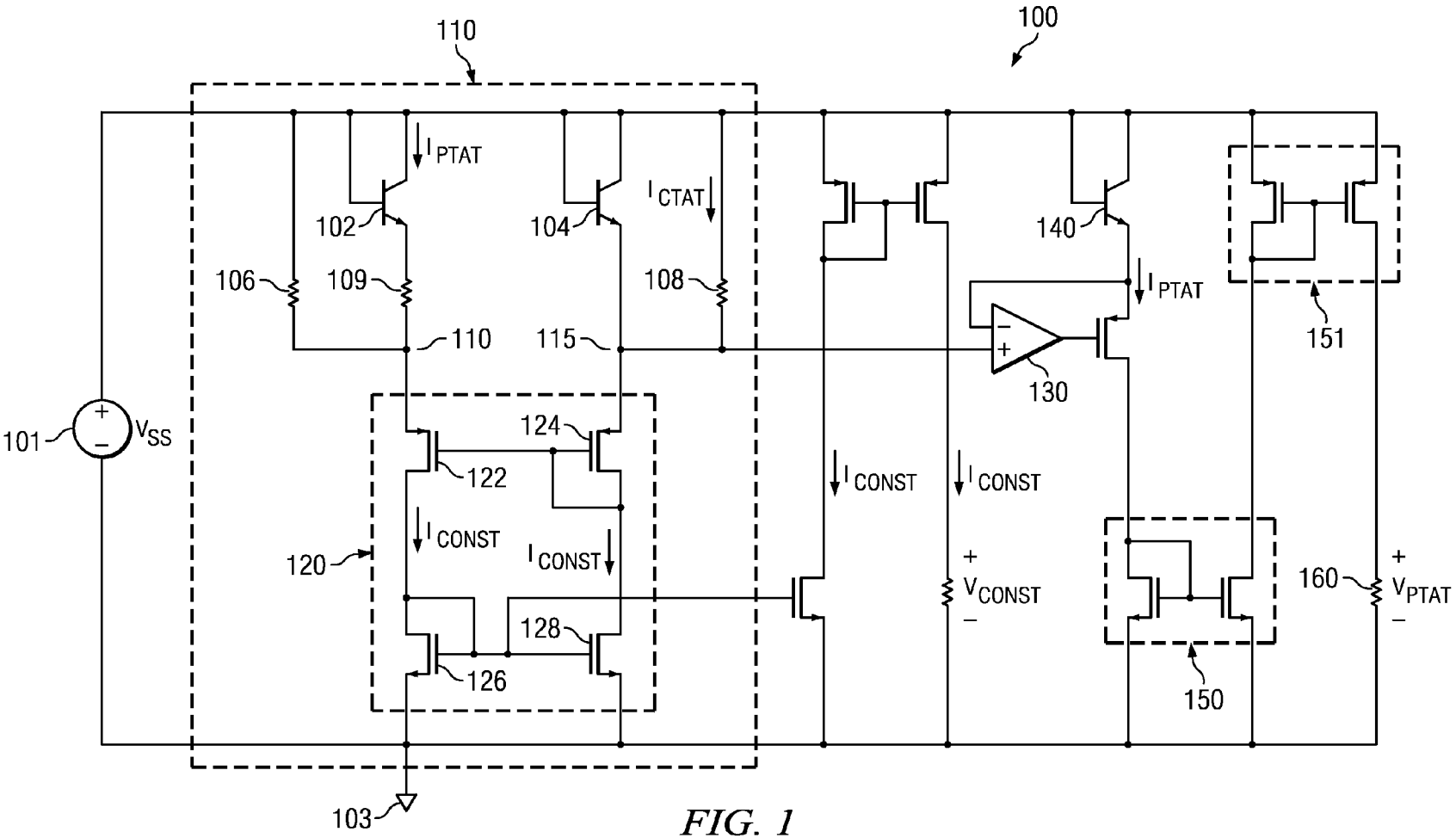
FIG. 1 (PRIOR ART)
FIG. 1 is a schematic of a conventional bandgap reference circuit.

Refer now to the drawings wherein depicted elements are, for the sake of clarity, not necessarily shown to scale and wherein like or similar elements are designated by the same reference numeral through the several views.

In general, the PTAT reference has a positive temperature coefficient and the CTAT reference has a negative temperature coefficient. However, the PTAT and CTAT temperature coefficients may not have substantially equal magnitudes, thereby preventing the temperature coefficients from canceling. In such examples, the CTAT and/or PTAT reference may be scaled by any suitable method such that the magnitude of the temperature coefficients are substantially equal, thereby canceling out the temperature coefficients by combining the CTAT and PTAT reference.

Generally, in the described examples and for the sake of clarity, the resistors of a bandgap reference do not have a temperature coefficient. In other words, the resistor resistance is substantially constant as the temperature of the system increases and/or decreases. However, in some examples, the resistors may still have a temperature coefficient. In such cases, the temperature coefficients of the PTAT current and/or CTAT current are affected by the temperature coefficients of the resistors. Accordingly, the CTAT and PTAT generation may be carried out to compensate for any resistance variation over temperature.

Figure 2:
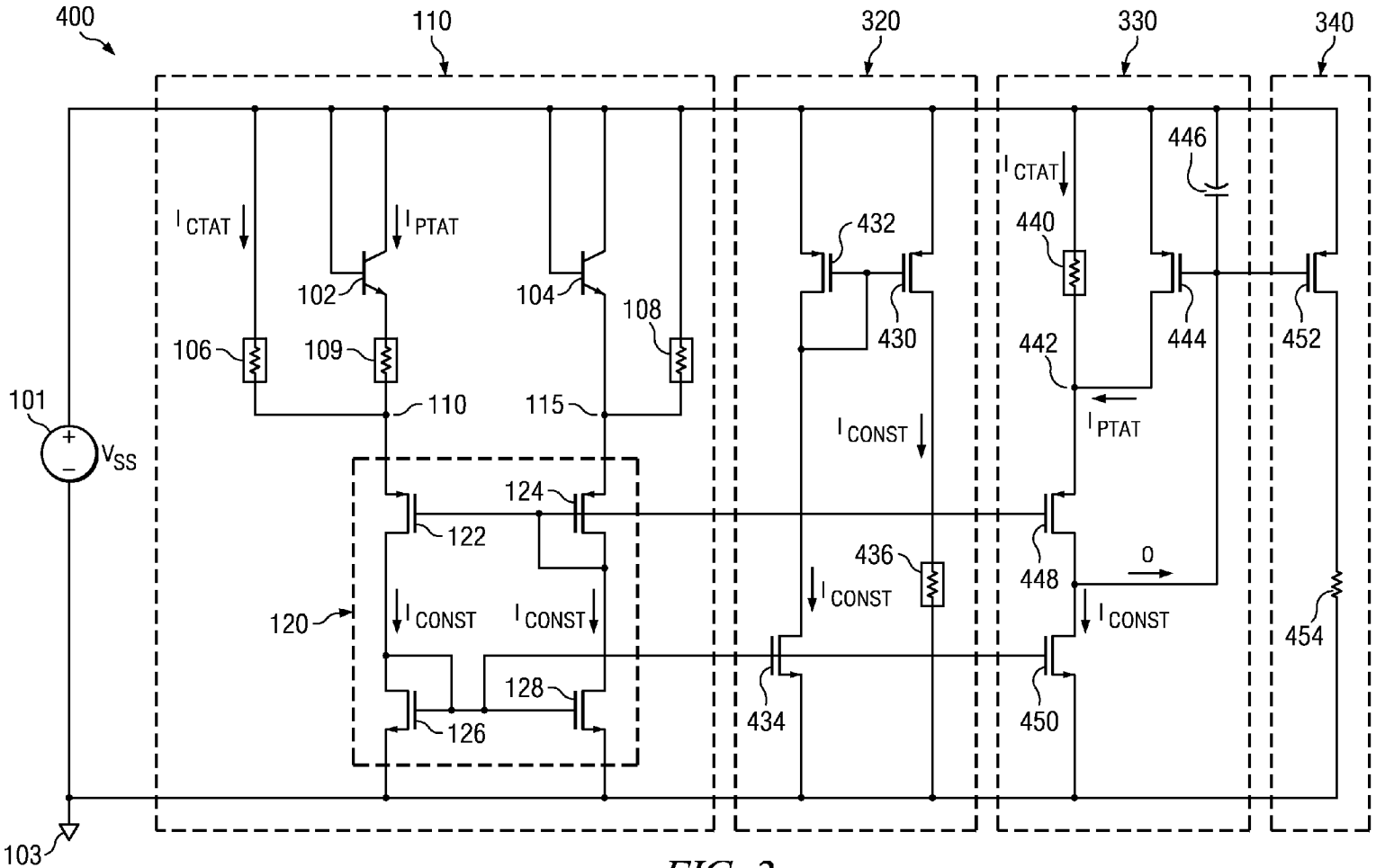
FIGS. 2 and 3 are schematic diagrams of example circuits to generate a PTAT voltage $V_{PTAT}$ in accordance with a preferred embodiment of the present invention.

Turing to FIG. 2, a schematic diagram of an example circuit 400 that generates a PTAT voltage $V_{PTAT}$ can be seen. Circuit 400 generally comprises a constant current generator 110, constant voltage generator 320, PTAT sensor 330, and PTAT voltage generator 340. Constant current generator 110 of has generally the same structure and operation as the constant current generator 110 of FIG. The constant current source 110 is then coupled to each of constant voltage generator 320 PTAT sensor 330 through control circuit 120.

The constant voltage generator 320 may be implemented by a PMOS transistor 430, a PMOS transistor 432, an NMOS transistor 434, and a resistor 436. The sources of both the PMOS transistors 430 and 432 are coupled to the voltage source 101. The gates of the PMOS transistors 430 and 432 are coupled to both the drain of the NMOS transistor 434 and the drain of the PMOS transistor 432. The NMOS transistor 434 receives the first output of the constant current generator 310 via its gate and its source is coupled to ground 103. The drain of the PMOS transistor 430 is coupled ground 103 via the resistor 436. Additionally, the NMOS transistor 434 is configured to match the NMOS transistor 126. Similarly, the PMOS transistors 430 and 432 are also matched.

The constant voltage generator 320 operates by receiving the gate-source voltage of the NMOS transistor 126 via the gate of the NMOS transistor 434. The gate-source voltage of the NMOS transistor 434 is set to have the same gate-source voltage as NMOS transistor 126, thereby mirroring the constant current $I_{CONST}$. Similarly, because the gates of the PMOS transistors 430 and 432 are coupled together, their respective drain-source currents are also be substantially equal. By coupling the drain and gate of the PMOS transistor 432 to each other, the PMOS transistor 430 forces its gate-source voltage to draw the current that the NMOS transistor 434 sinks (i.e., the constant current $I_{CONST}$). The PMOS transistor 432 thereby forces the constant current across the resistor 436 to generate a ground referenced constant voltage and the output of the constant voltage generator 320 is formed across the resistor 436. The resistance of resistor 436, for example, can be selected to have a resistance substantially equal to the value of resistors 106 and 109. However, the resistance of resistor 436, for example, can be selected to scale the constant voltage by a multiple (i.e., a ratio).

PTAT sensor 330 is formed by a resistor 440 that couples the voltage source 101 to a node 442. The source of a PMOS transistor 444 is coupled to the voltage source 101 and its gate is coupled to the voltage source 101 via a capacitor 446. Persons of ordinary skill in the art will readily appreciate that the capacitor 446 is optional and merely provides compensation to provide stability to circuit 400. The drain of the PMOS transistor 444 is further coupled to the source of a PMOS transistor 448 via the node 442. The PMOS transistor 448 is coupled to the gate of PMOS transistor 124 of the constant current generator 110 at its gate and its drain is coupled to the drain of an NMOS transistor 450. The NMOS transistor 450 is coupled to the gate of NMOS transistor 128 of the constant current generator 110 at its gate and its source is coupled to ground 103. The drain of the PMOS transistor 448 is also coupled to the gate of the PMOS transistor 444. Additionally, the NMOS transistor 450 is configured to match the NMOS transistor 126, and the PMOS transistors 444 and 448 are configured to match each other. The value of resistor 440 is also substantially equal to resistors 106 and 108.

The PTAT sensor 330 operates by sinking the constant current $I_{CONST}$ and subtracting the CTAT current $I_{CTAT}$ to generate the PTAT current $I_{PTAT}$. In operation, the NMOS transistor 450 mirrors the drain-source current of the NMOS transistor 126 (i.e., the constant current $I_{CONST}$). Persons of ordinary skill in the art will readily appreciate that no current can flow from the drain of the PMOS transistor 448 into the gate of the PMOS transistor 444. As described above, the gate of the PMOS transistor 448 receives the gate voltage of the PMOS transistor 124. The current flowing through PMOS transistor 448 is the constant current $I_{CONST}$, therefore the gate-source voltage of PMOS transistor 448 is substantially equal to the gate-source voltage of the PMOS transistor 124. In other words, the voltage at node 442 is forced to be the difference between the voltage source 101 and the base-emitter junction voltage of the NPN transistor 104 (i.e., $V_{SS}-V_{BE404}$), thereby forcing the CTAT current $I_{CTAT}$ to flow via the resistor 440.

However, the current flowing into the node 442 is equal to the current flowing from the node 442. As described above, the constant current $I_{CONST}$ flows out, therefore the current flowing from the drain of the PMOS transistor 444 follows:

$$I_{444}=I_{442}-I_{440}=I_{CONST}-I_{CTAT}=I_{PTAT} \tag{11}$$

where $I_{444}$ is the current flowing from the PMOS transistor 444, $I_{442}$ is the current flowing from the node 442, and $I_{440}$ is the current flowing across resistor 440. Because the PTAT current $I_{PTAT}$ is forced through the PMOS transistor 444, the voltage applied to the gate of the PMOS transistor 444 is forced to turn on the PMOS transistor 444 to allow the PTAT current to flow into the node 442.

As described above, to form the PTAT voltage $I_{PTAT}$, a PTAT voltage generator 340 is included. The PTAT voltage generator 340 is implemented by a PMOS transistor 452 that is matched with the PMOS transistor 444. Additionally, a resistor 454 may have a resistance substantially equal to the resistance of 106. Alternatively, the resistance of resistor 454 may be selected based on a ratio to generate a scaled PTAT voltage reference. The source of the PMOS transistor 452 is coupled to the voltage source 101 and the PMOS transistor 452 receives the output signal from the PTAT sensor 330 via its gate. The drain of the PMOS transistor 452 is coupled to ground 103 via the resistor 454.

The PTAT generator 340 operates by receiving the gate-source voltage of the PMOS transistor 444 via PMOS transistor 452, thereby mirroring the PTAT current. The PTAT current flows from the source of the PMOS transistor 452 to ground 103 across the resistor 454 and thereby produces the PTAT voltage. Therefore, the output from the PTAT voltage generator 340 is formed across the resistor 454.

In FIG. 2, the CTAT current $I_{CTAT}$ and the PTAT current $I_{PTAT}$ are generated in a single voltage loop and the transistors 102 and 104 are self-biased. To start circuit 400, a large enough current is provided via a startup circuit (not shown) to start the circuit so that current flows into the nodes 110 and 115. Initially, current does not flow via the transistors 102 and 104, and the current flows only via the resistors 106 and 108. The current flowing via resistors 106 and 108 may be large enough to turn off the startup circuit, thereby preventing any current from flowing via transistors 102 and 104. However, current must flow via transistors 102 and 104 to generate the bandgap reference in circuit 400.

Additionally, in the example of FIG. 2, the PTAT current $I_{PTAT}$ is formed via sensing the CTAT current $I_{CTAT}$ and subtracting the CTAT current $I_{CTAT}$ from the constant current $I_{CONST}$, thereby generating the PTAT current $I_{PTAT}$. Persons having ordinary skill in the art will readily appreciate that generating the PTAT current $I_{PTAT}$ by subtracting accurately reproduces the PTAT voltage $V_{PTAT}$, thereby avoiding any voltage mismatches due to intrinsic voltages by sensing the PTAT voltage $V_{PTAT}$ with operational amplifiers (e.g., a 1 millivolt mismatch associated with an operation amplifier produces a 4% mismatch error when translated into an emitter current at room temperature). Additionally, in FIG. 2, an extra transistor is not needed to generate the PTAT current $I_{PTAT}$, thereby preventing any inaccuracies due to potential temperature differences in the example circuit 400.

Figure 3:
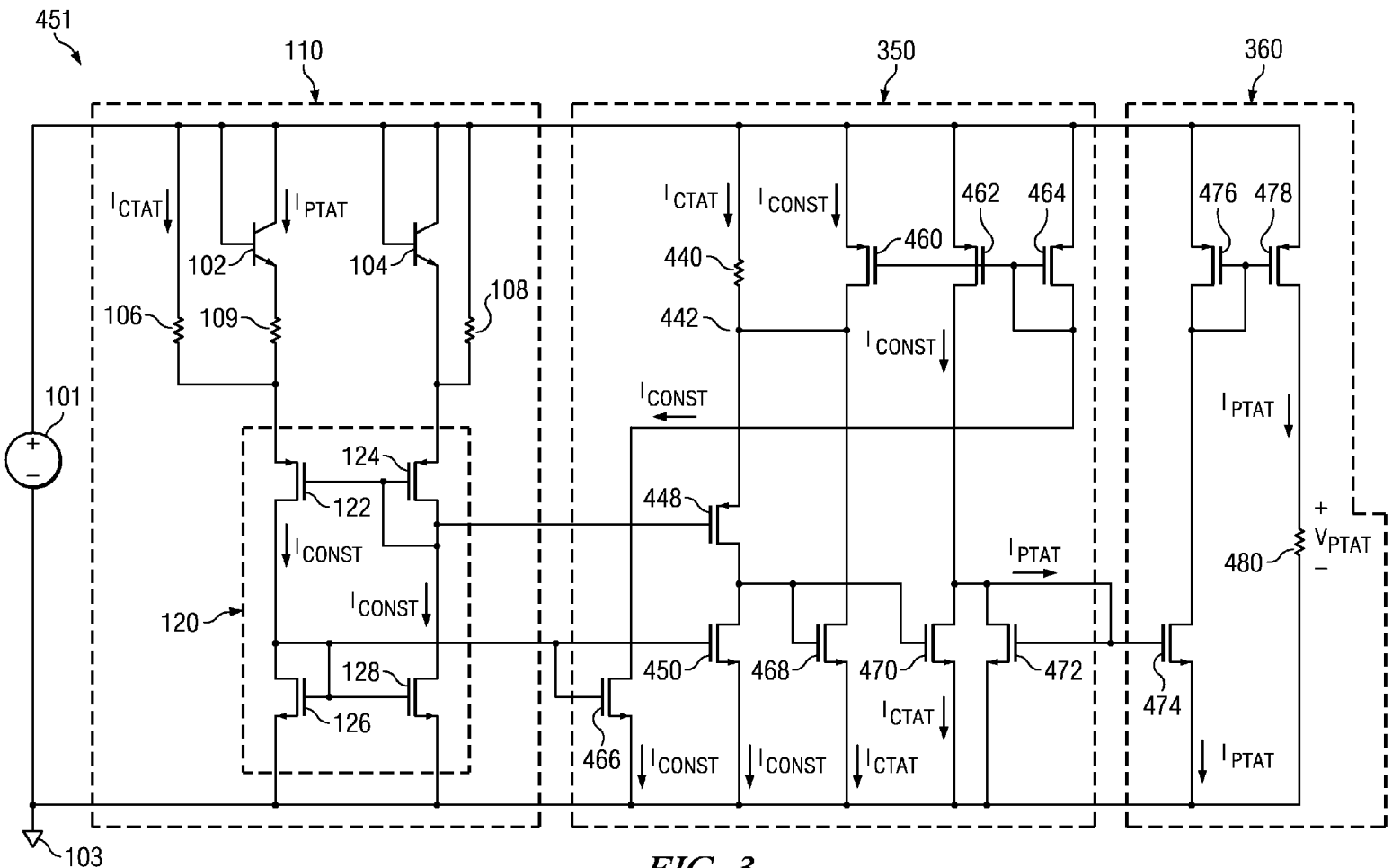

Turning now to FIG. 3, a schematic diagram of an example circuit 451 that generates a PTAT voltage $V_{PTAT}$ can be seen. In circuit 451, the constant current generator 110 operates similarly as described above in conjunction with FIGS. 1 and 2. A constant voltage generator 320, however, is not included in circuit 451, but the constant voltage generator 320 described in conjunction with FIG. 2 may be implemented into the example circuit 451.

The PTAT sensor 350 operates in a similar fashion as PTAT sensor 330 by subtracting the CTAT current $I_{CTAT}$ from the constant current $I_{CONST}$ to generate the PTAT current $I_{PTAT}$ PMOS transistor 448 mirrors the CTAT voltage $V_{CTAT}$ at the node 442, thus drawing the CTAT current $I_{CTAT}$ across resistor 440. An NMOS transistor 466 mirrors the constant current $I_{CONST}$, which causes a PMOS transistor 464 to source the constant current $I_{CONST}$ to the NMOS transistor 466. The PMOS transistor 464 is coupled to a PMOS transistor 462 and PMOS transistor 460. The PMOS transistor 464 causes the PMOS transistors 460 and 462 to source the constant current $I_{CONST}$. The PMOS transistor 460 sources the constant current $I_{CONST}$, however, the PMOS transistor 450 causes the constant current from PMOS transistor 460 to flow into the source of the PMOS transistor 448. As a result, the CTAT current $I_{CTAT}$ provided via the resistor 440 flows into the NMOS transistor 468. Because the current of the NMOS transistor 468 is the CTAT current $I_{CTAT}$, the drain of the NMOS transistor 450 is forced to apply a gate voltage to the NMOS transistor 468 that causes it to sink the CTAT current $I_{CTAT}$. An NMOS transistor 470 mirrors the current flowing into the NMOS transistor 468, and, as a result, sinks the CTAT current $I_{CTAT}$ from the drain of the PMOS transistor 462. The difference between the current flowing from PMOS transistor 462 and the current flowing into the NMOS transistor 470 flows into the NMOS transistor 472. Thus, the CTAT current $I_{CTAT}$ is subtracted from the constant current $I_{CONST}$ to generate the PTAT current $I_{PTAT}$. Thus, the NMOS transistor 472 sinks the PTAT current $I_{PTAT}$.

PTAT voltage generator 360 can then generate the PTAT voltage $V_{PTAT}$ from PTAT current $I_{PTAT}$. To do this, the PMOS transistor 476 sources the PTAT current $I_{PTAT}$ from NMOS transistor 474 (which mirrors the PTAT current $I_{PTAT}$ from NMOS transistor 472). PMOS transistor 478 is coupled with the PMOS transistor 476 so as to mirror the PTAT current $I_{PTAT}$, allowing the PTAT current $I_{PTAT}$ to flow across the resistor 480 to generate the PTAT voltage $V_{PTAT}$.

Figure 4:
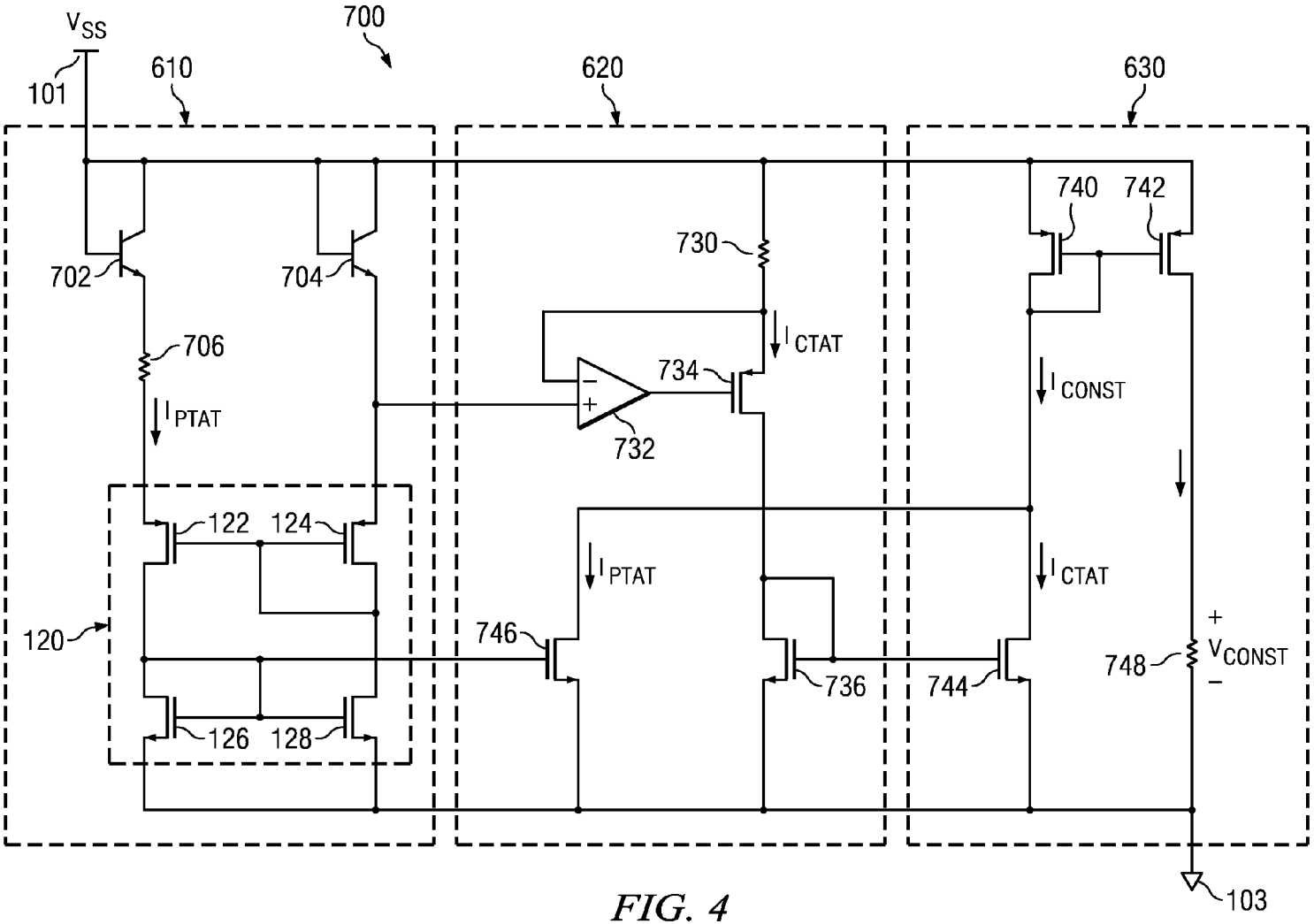
FIGS. 4 and 5 are a schematic diagrams of example circuit generate a CTAT voltage $V_{CTAT}$ in accordance with a preferred embodiment of the present invention.

Turning now to FIG. 4, a schematic diagram of a circuit 700 that generates a constant voltage $V_{CONST}$ in accordance with a preferred embodiment of the present invention. The PTAT generator 610 is implemented by a voltage source 101 coupled to an NPN transistor 702 and an NPN transistor 704. The NPN transistor 704 is selected to have a larger current density than the NPN transistor 702, thereby having a larger base-emitter voltage (i.e., $V_{BE}$) than the NPN transistor 702. The base and collector of the NPN transistors 702 and 704 are coupled to a voltage source 101, thereby causing both NPN transistors 702 and 704 to operate as a diode. The emitter of the NPN transistor 702 is coupled to a first input of a control circuit 720 via a resistor 706 and the emitter of the NPN transistor 704 is coupled to a second input of the control circuit 120.

The control circuit 120 forces the voltages and currents at the inputs of the control circuit 120 to be substantially equal. The voltage applied to the second input via the NPN transistor 704 is based on the base-emitter voltage of the NPN transistor 704 (i.e, $V_{SS}-V_{BE704}$). The current flowing via the NPN transistor 702 is controlled by the NPN transistors 702 and 704 and the resistor 706. A voltage loop equation to determine the current via the NPN transistor 704 is shown in equation (12):

$$V_{BE704}+V_{GS124}-V_{GS122}-I_{702}R_{706}-V_{BE702}=0 \tag{12}$$

where $V_{BE702}$ and $V_{BE704}$ are the respective base-emitter voltages of the NPN transistors 702 and 704, $V_{GS122}$ and $V_{GS124}$ are the respective gate-source voltage of the PMOS transistors 122 and 124, $R_{706}$ is the resistance of resistor 706, and $I_{702}$ is the current flowing from the NPN transistor 702. Based on the foregoing, the current flowing across the NPN transistors 702 and 704 is described by the equation (13):

$$I_{702} = \frac{V_{BE704} - V_{BE702}}{R_{706}} = \frac{\Delta V_{BE}}{R_{706}} = I_{PTAT} \tag{13}$$

where $V_{BE702}$ and $V_{BE704}$ are the respective base-emitter voltages of the NPN transistors 702 and 704, and $R_{706}$ is the resistance value of the resistor 706. An output of the PTAT generator 610 is formed at the emitter of the NPN transistor 704.

As described above, the PTAT current $I_{PTAT}$ of the PTAT generator 610 is generated by the NPN transistors 702 and 704. During startup of circuit 700, there is no alternate path that current can take to bypass the NPN transistors 702 and 704, thereby ensuring that current will flow via the NPN transistors 702 and 704. Because current only flows via NPN transistors 702 and 704, a startup circuit for the example circuit 700 is simple to implement.

To generate the CTAT current $I_{CTAT}$, the CTAT generator 620 senses the base-emitter voltage drop across the NPN transistor 704. To sense the base-emitter voltage, a negative input of operational amplifier 732 is coupled to the voltage source 101 via a resistor 730. The non-inverting terminal of the operational amplifier 732 receives a signal provided via the PTAT generator 610 (from the emitter of NPN transistor 704). The output of the operational amplifier 732 is coupled to a gate of a PMOS transistor 734 and the inverting terminal of the operational amplifier 732 is coupled to the source of the PMOS transistor 734. The drain of the PMOS transistor 734 is coupled to the gate and the drain of an NMOS transistor 736. The source of the NMOS transistor 736 is coupled to ground 103 and its gate forms the output of the CTAT generator 620.

As described above, the non-inverting terminal of the operational amplifier 732 is coupled to the output of the PTAT generator 610. Persons of ordinary skill in the art will readily appreciate that by applying a voltage to the non-inverting terminal of the operational amplifier 732, the inverting terminal of the operational amplifier 732 is forced to have the same voltage. Therefore, the voltage across the resistor 730 is fixed and the current flowing through resistor 730 is shown in equation 14:

$$I_{730} = \frac{V_{BE704}}{R_{730}} = I_{CTAT} \tag{14}$$

where $I_{730}$ is the current flowing through the resistor 730, $V_{BE704}$ is the base-emitter voltage drop across the NPN transistor 704, and $R_{730}$ is the resistance of resistor 730.

In the operation of the CTAT generator 620, persons having ordinary skill in the art will readily appreciate that the current does not flow into the inverting terminal of the operational amplifier 732, thereby forcing the operational amplifier 732 to set the gate-source voltage of the PMOS transistor 734 to draw the CTAT current $I_{CTAT}$. The CTAT current $I_{CTAT}$ flows into the drain of the NMOS transistor 736 and no current flows into the gate of the NMOS transistor 736. The gate-source voltage of the NMOS transistor 736 is thereby forced to allow the CTAT current $I_{CTAT}$ to flow into ground 103. The gate of the NMOS transistor 736 also outputs a signal to reproduce the CTAT current $I_{CTAT}$.

Figure 7:
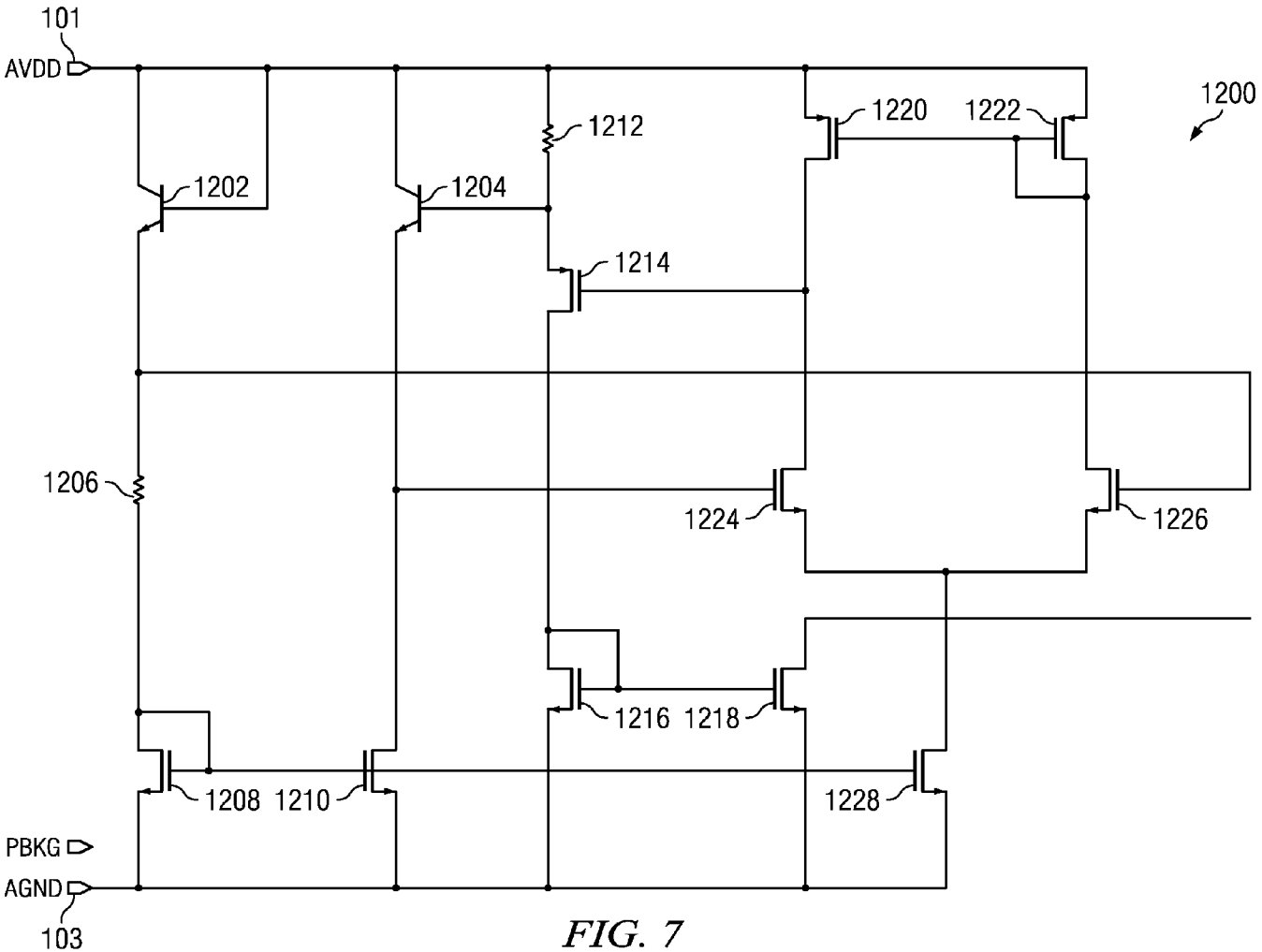
FIG. 7 is schematic diagram of an example circuit to implement the PTAT generator of FIG. 6 in accordance with a preferred embodiment of the present invention.

The constant voltage generator 630 is implemented by a PMOS transistor 740 and a PMOS transistor 742. The sources of the PMOS transistors 740 and 742 are coupled to the voltage source 101. The gates of the PMOS transistors 740 and 742 are coupled to the drain of the PMOS transistor 740. Additionally, the drain of the PMOS transistor 740 is coupled to the drain of an NMOS transistor 744 and the drain of an NMOS transistor 746. The gate of the NMOS transistor 744 receives the output signal from the CTAT generator 620 and the gate of the NMOS transistor 746 receives a signal from the PTAT generator 610. The sources of both NMOS transistors 744 and 746 are coupled to ground 103. Additionally, the drain of the PMOS transistor 742 is coupled to ground 103 via a resistor 748. In the example of FIG. 7, the PMOS transistors 740 and 742 are matched and the NMOS transistors 744 and 746 are configured to match the NMOS transistor 126.

In the operation of the constant voltage generator 630, the gate-source voltage of the NMOS transistor 744 is configured to have a gate-source voltage substantially equal to the NMOS transistor 736, thereby forcing the NMOS transistor 744 to mirror the CTAT current $I_{CTAT}$. However, the NMOS transistor 746 is configured to have a gate-source voltage equal or substantially equal to the gate-source voltage of the NMOS transistor 126, thereby mirroring the PTAT current $I_{PTAT}$.

Persons of ordinary skill in the art will readily appreciate the current flowing into the drain of the PMOS transistor 740 must be equal or substantially equal to the current flowing from it. The NMOS transistors 744 and 746 sink current from the drain of the PMOS transistor 740, thereby forcing the gate-source voltage of the PMOS transistor 740 so that it sources both of the currents. As a result, the current sourced by PMOS transistor 740 is the sum of CTAT current $I_{CTAT}$ and the PTAT current $I_{PTAT}$, thereby generating the constant current $I_{CONST}$. To source the constant current $I_{CONST}$, the gate-source voltage of the PMOS transistor 740 is forced based on the constant current $I_{CONST}$. The PMOS transistor 742 receives the same gate-source voltage and mirrors the constant current $I_{CONST}$, which flows across the resistor 748 into ground 103. Therefore, the voltage across the resistor 748 is the constant voltage and the output of the constant voltage generator 630 is formed across the resistor 748.

Figure 5:
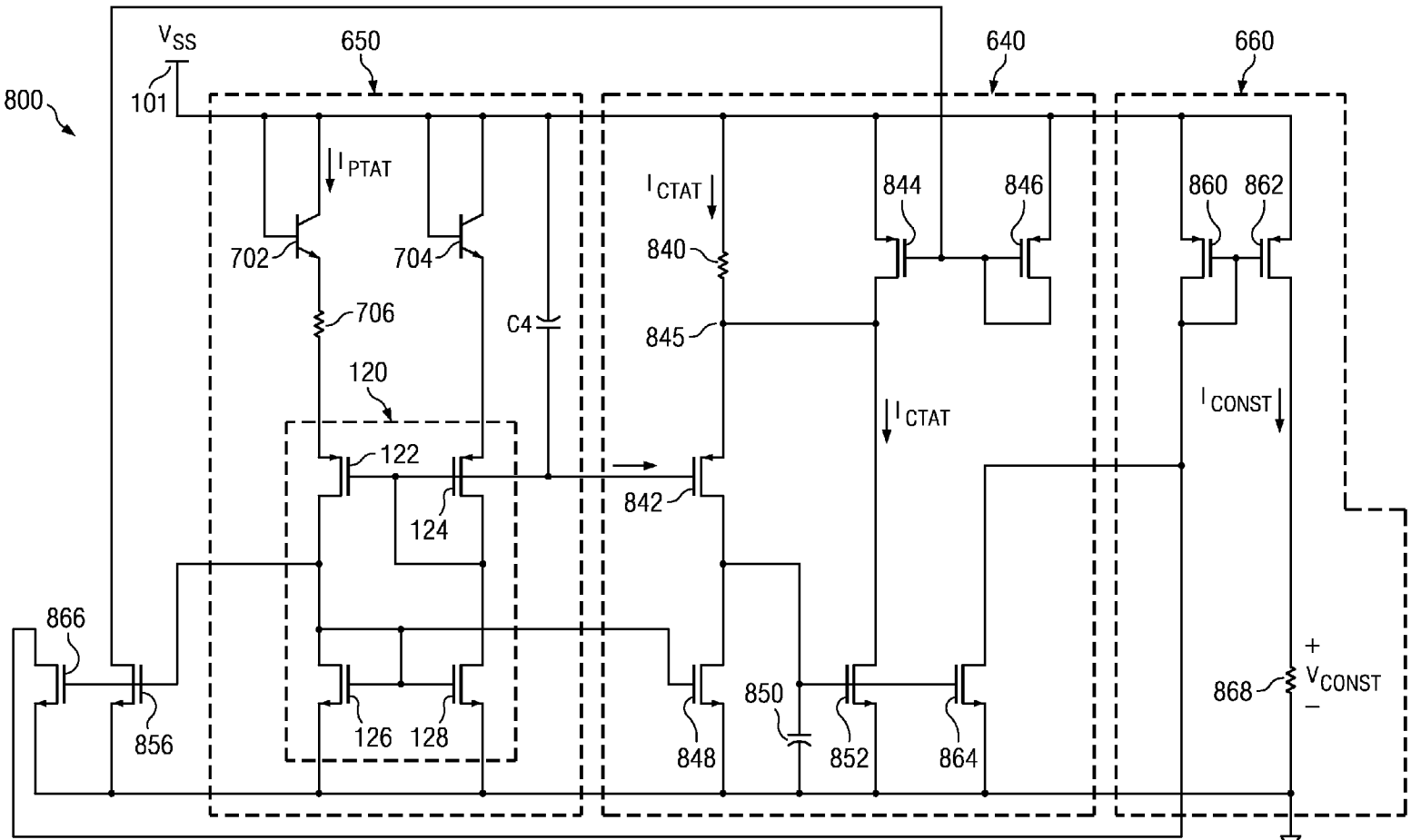

Turning to FIG. 5, a schematic diagram of a circuit 800 that generates a constant voltage in accordance with a preferred embodiment of the present invention can be seen. Circuit 800 generally comprises a PTAT generator 650, a CTAT generator 640, and constant voltage generator 660, In FIG. 5, PTAT generator 650 is similar in structure and operation to PTAT generator 610; a difference, however, is that PTAT generator 650 includes a capacitor C4 that is coupled between the voltage source 101 and the gate of transistor 124 of the control circuit 120. As described above, the NPN transistors 702 and 704 are configured to have different current densities, thereby having different base-emitter junction voltages. The difference in the base-emitter voltages must therefore be the voltage drop across the resistor 706 due to the control circuit 120. Therefore, the current flowing into the control circuit 120 is the PTAT current $I_{PTAT}$ and the voltage at the inputs of the control circuit 120 is the difference between the voltage of the voltage source 101 and the base-emitter junction voltage of the NPN transistor 704.

CTAT generator 640 generally comprises a resistor 840, a PMOS transistor 842, a PMOS transistor 844, a PMOS transistor 846, an NMOS transistor 848, a capacitor 850, an NMOS transistor 852, and an NMOS transistor 856. The PMOS transistors 842, 844, and 846 are configured to match the PMOS transistor 124. Similarly, the NMOS transistors 848, 852, and 856 match the NMOS transistor 126. The resistor 840 may be selected to scale the voltage drop across the resistor 840 based on the resistance of resistor 706. By scaling the ratio correctly, the positive temperature coefficient of the PTAT current $I_{PTAT}$ and the negative temperature coefficient of the CTAT current $I_{CTAT}$ cancel each other out, thereby allowing the CTAT current $I_{CTAT}$ and PTAT current $I_{PTAT}$ to be combined to produce a temperature independent reference.

The source of the PMOS transistor 842 is coupled to the voltage source 101 via the resistor 840, the drain of the PMOS transistor 844, and the drain of the NMOS transistor 852. The gate of the PMOS transistor 842 receives a signal of the PTAT generator 650. The drain of the PMOS transistor 842 is coupled to the drain of the NMOS transistor 848 and the gate of the NMOS transistor 852. Additionally, the drain of the PMOS transistor 842 is coupled to ground 103 via the capacitor 850. The drain of the NMOS transistor 842 also forms the output of the CTAT generator 640.

The gate of the NMOS transistor 848 receives a signal of the PTAT generator 650 and its source is coupled to ground 103. The source of the NMOS transistor 852 is also coupled to ground 103. The sources of both PMOS transistors 844 and 846 are coupled to the voltage source 101. The gates of the PMOS transistors 844 and 846 and the drain of the PMOS transistor 846 are all coupled to the drain of the NMOS transistor 856. The gate of the NMOS transistor 856 also receives a signal of the PTAT generator 650.

In the operation of the CTAT generator 640, the gate-source voltage applied to the NMOS transistor 848 is substantially equal to the gate-source voltage of the NMOS transistor 126, thereby setting the current drawn via NMOS transistor 848 to be substantially equal to the current drawn via the NMOS transistor 126. In other words, the NMOS transistor 848 mirrors the PTAT current $I_{PTAT}$. Persons having ordinary skill in the art will readily appreciate that no current flows to ground 103 via the capacitor 850 and no current flows into the gate of the NMOS transistor 852. The capacitor 850 may be included to provide compensation, thereby stabilizing the example circuit 800.

The current flowing into the NMOS transistor 842 is substantially equal to the current flowing out (i.e., the PTAT current $I_{PTAT}$). However, the gate of the NMOS transistor 842 receives a signal of the PTAT generator 650, thereby forcing the voltage at the source of the PMOS transistor 842 to be the difference between the voltage source and the base-emitter voltage of the NPN transistor 704 (i.e., $V_{SS}-V_{BE804}$). Because the voltage at the source of the PMOS transistor 842 is forced based on the base-emitter junction voltage of the NPN transistor 704 (i.e., the CTAT voltage), the current across the resistor 840 is forced to be the CTAT current $I_{CTAT}$. The NMOS transistor 856 also receives a signal from the PTAT generator 650, thereby mirroring the PTAT current $I_{PTAT}$ of the NMOS transistor 126. The PMOS transistor 846 provides the PTAT current $I_{PTAT}$ for the NMOS transistor 856 and the PMOS transistor 844 mirrors the current of the PMOS transistor 846.

The current provided via the PMOS transistor 846 flows into a node that is coupled to the source of the PMOS transistor 842 and the drain of the NMOS transistor 852. The CTAT current $I_{PTAT}$ and the PTAT current $I_{CTAT}$ therefore flow into the node and persons having ordinary skill in the art will readily appreciate that the current flowing into the node must be equal or substantially equal to the current flowing out of the node. As described above, the PTAT current $I_{PTAT}$ is forced to flow into the source of the PMOS transistor 842, thereby forcing the CTAT current $I_{CTAT}$ to flow into the drain of the NMOS transistor 852. The gate-source voltage of the NMOS transistor 852 is therefore set by the CTAT current $I_{CTAT}$ to allow the CTAT current $I_{CTAT}$ to flow into ground 103. The gate of the NMOS transistor 852 also outputs a signal from the CTAT generator 640 for the purpose of reproducing the CTAT current $I_{CTAT}$.

The constant voltage generator 660 is implemented by a PMOS transistor 860, a PMOS transistor 862, an NMOS transistor 864, an NMOS transistor 866, and a resistor 868. The sources of the PMOS transistors 860 and 862 are coupled to the voltage source 101. The gate and drain of the PMOS transistor 860 and the gate of the PMOS transistor 862 are coupled to the drains of the NMOS transistors 864 and 866. The NMOS transistor 864 receives the output signal from the CTAT generator 640 via its gate and the NMOS transistor 866 receives a signal of the PTAT generator 650 via its gate. The sources of both NMOS transistors 866 and 864 are coupled to ground 103. The source of the PMOS transistor 862 is coupled to ground 103 via the resistor 868. The PMOS transistors 860 and 862 are matched. Optionally, the PMOS transistors 860 and 862 may match the PMOS transistor 124. Similarly, the NMOS transistors 864 and 866 are configured to match the NMOS transistor 826. Because the NMOS transistor 864 receives the output signal of the CTAT generator 640, its gate-source voltage is set to be substantially equal to the gate-source of the NMOS transistor 852, thereby mirroring the CTAT current $I_{CTAT}$. Similarly, the NMOS transistor 866 receives a signal of the PTAT generator 650 and its gate-source voltage is set to be substantially equal to the gate-source of the NMOS transistor 826, thereby mirroring the PTAT current $I_{PTAT}$. Persons having ordinary skill in the art will readily appreciate the current flowing from the drain of the PMOS transistor 860 is equal or substantially equal to the current flowing into the drains of the NMOS transistors 864 and 866. Therefore, the current flowing from the drain of the PMOS transistor 860 is the sum of the PTAT current $I_{PTAT}$ and CTAT current $I_{CTAT}$ to be the constant current $I_{CONST}$. The gate-source voltage of the PMOS transistors 860 and 862 are therefore set to allow the constant current to flow from the drains of the PMOS transistors 860 and 862. The constant current therefore flows across resistor 868 to generate a constant voltage. The output of the constant voltage generator 660 is thereby formed across the resistor 868.

Figure 6:
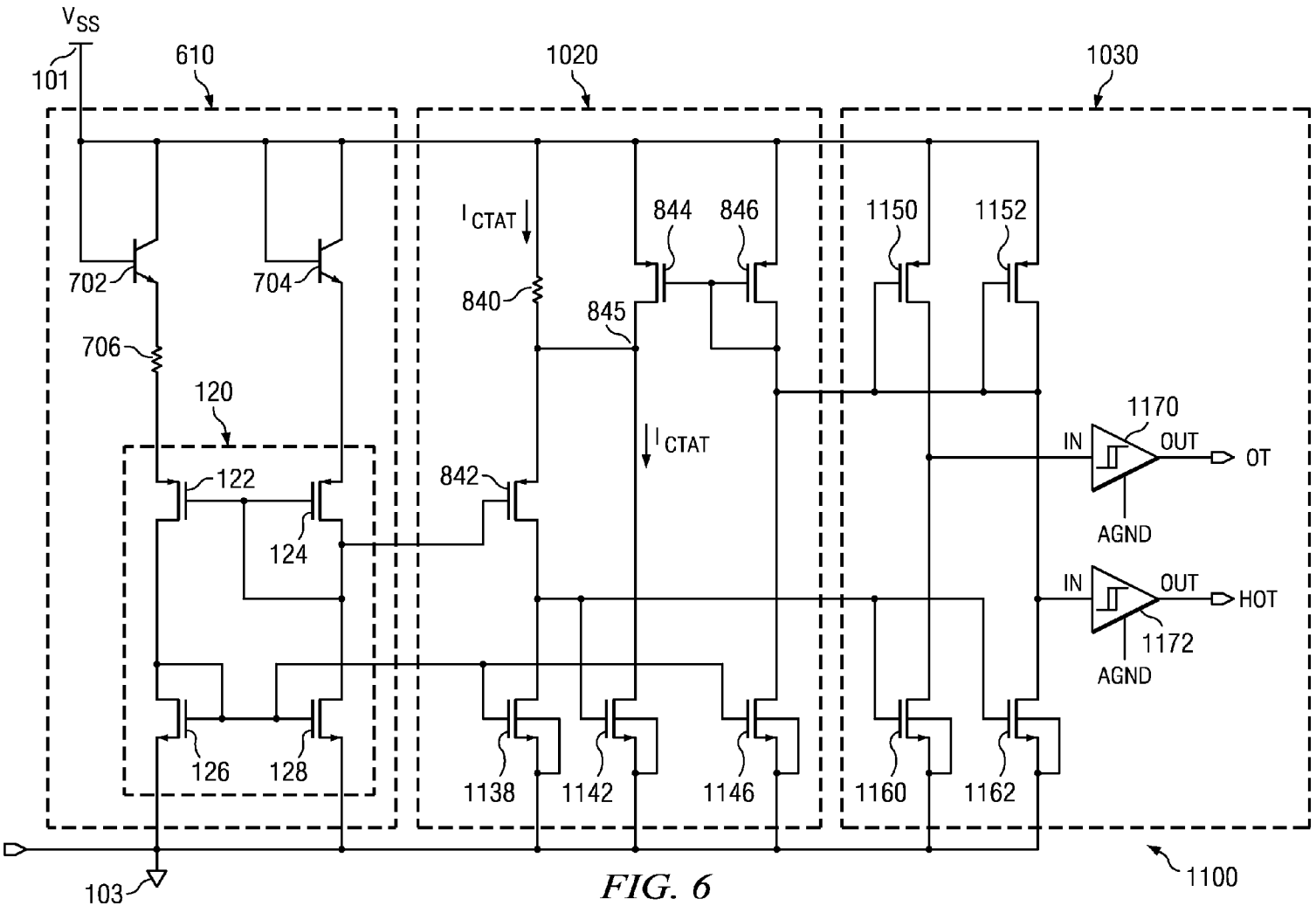
FIG. 6 is a schematic diagram of an example circuit to detect temperature in accordance with a preferred embodiment of the present invention.

Turning to FIG. 6, a schematic diagram of an example circuit 1100 to detect temperature in accordance with a preferred embodiment of the present invention can be seen. Circuit 1100 generally comprises PTAT generator 610, CTAT generator 1020, and temperature detector 1030. CTAT generator 1020 is similar in structure and operation to CTAT generator 640, but there are some differences. NMOS transistors 848, 852, and 846 are replaced with NMOS transistors 1138, 1142, and 1146 (which are configured to match the NMOS transistor 126), and capacitor 850 is omitted. The temperature detector 1030 is implemented by a PMOS transistor 1150 and an NMOS transistor 1160. Additionally, the example temperature detector 1030 may include Schmitt triggers 1170 and 1172. Persons having ordinary skill in the art will readily appreciate that the Schmitt triggers 1170 and 1172 provide noise immunity to the outputs of the example circuit 1100, thereby preventing false detections due to noise. The NMOS transistor 1160 is configured to match the NMOS transistor 126 and the PMOS transistor 1150 is configured to match the PMOS transistor 122.

For temperature sensor 1030, the source of the PMOS transistor 1150 is coupled to the voltage source 101. The source of the NMOS transistor 1160 is coupled to ground 1103. The drain of the PMOS transistor 1150 is coupled to the drain of the NMOS transistor 1160 and the input of the Schmitt trigger 1170. Schmitt trigger 1170 forms an output of the example circuit 1100. NMOS transistor 1160 receives a signal from the CTAT generator 1020 via its gate. The gate-source voltage of the NMOS transistors 1160 is therefore configured to sink up to the drain-source current of the NMOS transistor 1142 (i.e., the CTAT current $I_{CTAT}$). At the same time, the PMOS transistor 1150 receives a signal of the CTAT generator 1020 (i.e., the gate-source voltage of the PMOS transistor 846). The PMOS transistor 1150 has the same gate-source voltage as the PMOS transistor 846, thereby forcing the PMOS transistor 1150 to source the PTAT current $I_{PTAT}$. The input of the Schmitt trigger 1170 is a high impedance node and the PMOS transistor 1150 is configured to source current to the NMOS transistor 1160. At the same time, the NMOS transistor 1160 is configured to sink the CTAT current $I_{CTAT}$. However, if the current the NMOS transistor 1160 is configured to sink is greater than the current the PMOS transistors 1150 is configured to source, the result will be that the voltage on the shared drains will be close to the ground voltage since that is the voltage at which equilibrium will be reached. On the other hand, if the PMOS transistor 1150 is configured to source a larger current than the NMOS transistor 1160 is configured to sink, the result will be that the voltage on the shared drains will be close to the supply voltage (e.g., $V_{SS}$) since that is the voltage at which equilibrium will be reached. As a result, the temperature detector 1030 compares the currents and outputs a low when the temperature does not exceed a threshold. When the temperature exceeds the threshold, the temperature detector 1030 outputs a high.

As can be seen, the circuit 1100 is configured to detect two temperatures. However, the example circuit 1100 may be configured to detect any number of temperatures. For example by implementing a PMOS transistor 1152, an NMOS transistor 1162, and a Schmitt trigger 1172, a second temperature may be detected. In such an example, the PMOS transistor 1152 may be configured to source a different current (e.g., by having a different gate width-to-length ratio) than the PMOS transistor 1150, thereby causing the Schmitt trigger 1172 to output a high voltage at a second temperature.

Turning now to FIG. 7, circuit 1200, which is an alternative PTAT generator. Circuit 1200 includes a voltage source 101, an NPN transistor 1202, a ground 103, an NPN transistor 1204, a resistor 1206, an NMOS transistor 1208, an NMOS transistor 1210, a resistor 1212, a PMOS transistor 1214, an NMOS transistor 1216, an NMOS transistor 1218, a PMOS transistor 1220, a PMOS transistor 1222, an NMOS transistor 1224, an NMOS transistor 1226, and an NMOS transistor 1228. The base and collector of the NPN transistor 1202 are coupled to the voltage source 101 to form a diode. The collector of the NPN transistor 1204 is coupled to the voltage source 101 and its base is coupled to the voltage source 101 via the resistor 1212. The emitter of the NPN transistor 1202 is coupled to the drain and gate of the NMOS transistor 1208 and the gate of the NMOS transistor 1210 via the resistor 1206. The sources of both NMOS transistors 1208 and 1210 are coupled to ground 103. The drain of the NMOS transistor 1210 is coupled to the emitter of the NPN transistor 1204 and the gate of the NMOS transistor 1224. Additionally, the emitter of the NPN transistor 1202 is coupled to the gate of the NMOS transistor 1226. The source of the PMOS transistors 1220 and 1222 are coupled to the voltage source 101. Additionally, the gates of the PMOS transistors 1220 and 1222 and the drain of the PMOS transistor 1222 are coupled to the drain of the NMOS transistor 1226. The drain of the PMOS transistor 1220 is coupled to the gate of the PMOS transistor 1214 and the drain of the NMOS transistor 1224. The drain of the PMOS transistor 1214 is coupled to the drain of the NMOS transistor 1216 and the gates of the NMOS transistors 1216 and 1218. The sources of both NMOS transistors 1216 and 1218 are coupled to ground 103. The sources of the NMOS transistors 1224 and 1226 are coupled to the drain of the NMOS transistor 1228. The gate of the NMOS transistor 1228 is coupled to the gates of the NMOS transistors 1208 and 1210. Similarly, the NMOS transistor 1228 is coupled to ground 103.

In operation, a current flowing via the resistor 1206 is mirrored via the NMOS transistors 1208 and 1210, causing the NPN transistors 1204 and 1202 to have substantially the same current. In addition, the current flowing via resistor 1206 is also mirrored by NMOS transistor 1228, thus, causing the differential pair formed via the NMOS transistors 1224 and 1226 to be biased. However, the NMOS transistors 1224 and 1226 are coupled to the emitters of NPN transistors 1202 and 1204, respectively. The NMOS transistors 1224 and 1226 thereby form a feedback path via their gates. As a result, the current flowing via the NMOS transistor 1224 causes the PMOS transistor 1214 to force the PTAT voltage across resistor 1212. As a result, because the feedback forces the same or substantially same voltage at the emitters of the NPNs the current flowing through resistor 1212 is the PTAT current $I_{PTAT}$ and the NMOS device 1216 causes the NMOS device 1218 to mirror the PTAT current $I_{PTAT}$. Thus, the example of FIG. 7 does not need a separate startup circuit.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

What is claimed is:

1. An apparatus comprising:

a first voltage rail;

a second voltage rail;

a current generator that provides at least one of a first current that is proportional to absolute temperature, a second current that is complementary to absolute temperature, and a third current that is generally constant, wherein the current generator has a first stage and a second stage, wherein the first stage includes:

a first bipolar transistor that is coupled to the first voltage rail at its base and its collector;

a second bipolar transistor that is coupled to the first voltage rail at its base and its collector;

a first resistor that is coupled to the emitter of the first bipolar transistor;

a first current mirror having a first terminal, a second terminal, a third terminal, and a fourth terminal, wherein the first and second terminals of the first current mirror are coupled to the first resistor and the emitter of the second transistor, respectively; and a second current mirror having a first terminal, a second terminal, a third terminal, and a fourth terminal, wherein the first and second terminals of the second current mirror are coupled to the third and fourth terminals of the first current mirror, and wherein the third and fourth terminals of the second current mirror are coupled to the second voltage rail;

and wherein the second stage includes:

a second resistor that is coupled to the first voltage rail;

a first MOS transistor that is coupled to the second resistor at its source and that is coupled to the fourth terminal of the first current mirror at its gate; and a second MOS transistor that is coupled to the drain of the first MOS transistor at its drain and that is coupled to the third terminal of the first current mirror at its gate; and an output stage that is coupled to the current generator so as to generate at least one of a first voltage that is generally constant, a second voltage that is proportional to absolute temperature, and a third voltage that is complementary to absolute temperature from at least one of the first current, the second current, and the third current.

2. The apparatus of claim 1, wherein the first stage further comprises:

a third resistor that is coupled between the first voltage rail and the first terminal of the first current mirror; and a fourth resistor that is coupled between the first voltage rail and the second terminal of the first current mirror.

3. The apparatus of claim 2, wherein the second stage further comprises:

a third current mirror with a first terminal coupled to the first voltage rail, a second terminal coupled to the first voltage rail, a third terminal, and a fourth terminal;

a third MOS transistor that is coupled to the third terminal of the third current mirror at its drain; and a fourth MOS transistor that is coupled to the first voltage rail at its source, the source of the first MOS transistor at its drain, and the gates of the first and second MOS transistors at its gate.

4. The apparatus of claim 1, wherein the first stage further comprises a capacitor that is coupled between the first voltage rail and the gate of the first MOS transistor at its gate.

5. The apparatus of claim 3, wherein the output stage comprises a PTAT voltage generator having:

a fifth MOS transistor that is coupled to the gate of the fourth MOS transistor at its gate; and a fourth current mirror that is coupled to the source of the fifth MOS transistor.

6. The apparatus of claim 1, wherein the first stage further comprises a PTAT current generator and the second stage further comprises a complementary to absolute temperature (CTAT) current generator.

7. The apparatus of claim 6, wherein the output stage comprises a temperature detector.

8. The apparatus of claim 1, wherein the second voltage rail is coupled to ground.

* * * * *